US006847028B2

(12) United States Patent
Ishizu et al.

(10) Patent No.: US 6,847,028 B2
(45) Date of Patent: Jan. 25, 2005

(54) PHOTOMULTIPLIER TUBE

(75) Inventors: Tomohiro Ishizu, Hamamatsu (JP); Suenori Kimura, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 192 days.

(21) Appl. No.: 10/343,023

(22) PCT Filed: Jul. 19, 2001

(86) PCT No.: PCT/JP01/06280

§ 371 (c)(1),
(2), (4) Date: Jan. 27, 2003

(87) PCT Pub. No.: WO02/11178

PCT Pub. Date: Feb. 7, 2002

(65) Prior Publication Data

US 2003/0146697 A1 Aug. 7, 2003

(51) Int. Cl.[7] ..... H01J 40/14; H01J 43/06

(52) U.S. Cl. ..... 250/214 VT; 250/207; 313/533; 313/541; 313/103 CM

(58) Field of Search ..... 250/214 VT, 207; 313/532, 533, 534, 540, 541, 542, 103 R, 103 CM, 104, 105 R, 105 CM

(56) References Cited

U.S. PATENT DOCUMENTS

| | | | | |
|---|---|---|---|---|
| 4,415,832 | A | | 11/1983 | Faulkner et al. |
| 4,577,137 | A | | 3/1986 | Kaiser |
| 5,936,348 | A | * | 8/1999 | Shimoi et al. ..... 313/533 |
| 6,794,629 | B2 | * | 9/2004 | Kato et al. ..... 250/214 VT |

FOREIGN PATENT DOCUMENTS

| | | |
|---|---|---|
| JP | 52-8377 | 2/1977 |

* cited by examiner

*Primary Examiner*—Kevin Pyo
(74) *Attorney, Agent, or Firm*—Oliff & Berridge, PLC

(57) ABSTRACT

A photomultiplier tube excellent in vibration resistance and having an anode with good pulse linearity characteristic. The photomultiplier tube has a mesh anode (A) composed of an anode frame (A11) and a mesh electrode (A12) supported and surrounded by the anode frame (A11). The central portion of one long side (A11B) of the anode frame (A11) serves as an electron converging part (F). The inner side of the anode frame (A11) swells toward the inner part of the anode (A), more from the middle of the long side (A11B) toward the corners of the anode frame (A11) along the long side (A11B), and therefore the thickness of the anode frame (A11) increases from the middle of the long side (A11) to the corners along the long side (A11B).

7 Claims, 7 Drawing Sheets

PHOTOMULTIPLIER TUBE

TECHNICAL FIELD

The present invention relates to a photomultiplier tube, and particularly to a photomultiplier tube used in oil exploration and the like.

BACKGROUND ART

A type of photomultiplier tube with a shortened axial dimension that has a pole-shaped anode and circular gauge dynodes is well known in the art for use in devices employed in oil exploration or in other devices that vibrate severely.

Japanese unexamined patent application publication No. HEI-2-291655 discloses a photomultiplier tube having a circular gauge type electron multiplying unit and a pole-shaped anode. In the circular gauge type electron multiplying unit, a path formed in the spaces between opposed dynodes traces an arc around an axis orthogonal to the tube axis. The dynode of the second stage and the anode are positioned on opposing ends relative to the tube axis. Accordingly, the photomultiplier tube can be contracted in its axial direction, reducing the overall size of the tube construction.

In order to form an arcuate path in the spaces between opposed dynodes, concave dynodes are positioned on the outer side of the arc, while dynodes having a substantially flat surface are arranged on the inner side of the arc, wherein the inner dynodes have a smaller surface area than the outer dynodes. The anode is pole-shaped, but configured to encompass the dynode of the final stage. This type of photomultiplier tube has exceptional resistance to vibration due to the pole shape of its anode and therefore is not easily damaged by vibrations. Accordingly, the photomultiplier tube can be used for oil exploration and other environments of high temperature and high vibration.

However, since this type of photomultiplier tube designed for high temperature and high vibration environments is configured with a pole-shaped anode and a circular gauge dynode enclosing the pole-shaped anode, the photomultiplier tube does not have good pulse linearity.

On the other hand, a photomultiplier tube well known in the art provided with a mesh anode instead of a pole-shaped anode, while not designed for use in oil exploration and other high temperature and high vibration environments, has good pulse linearity characteristics. Unlike the pole-shaped anode, the mesh anode can be positioned near the dynode of the final stage to increase the field intensity using parallel fields. Since it is possible to suppress the effects of the space charge effect, the photomultiplier tube can achieve good pulse linearity characteristics.

Japanese unexamined patent application publication No. SHO-60-254547 discloses a photomultiplier tube having a substantially rectangular mesh anode. The mesh anode has an anode frame, the inner and outer sides of which are both substantially rectangular in shape, and an opening formed in the anode frame. A mesh electrode is fixed in the opening. The inner surface of the anode frame has two linear short sides and a linear long side connected by curved surfaces forming arcs of a circle with a prescribed curvature. The electron multiplying unit is a box type. Electrons multiplied through box-type dynodes in a plurality of stages impinge on the entire opening of the anode frame, but do not converge on a part of the opening.

Japanese examined patent application publication No. SHO-61-17099 discloses a photomultiplier tube having an anode that includes a square-shaped mesh anode and an anode frame retaining the mesh anode. As shown in FIG. 8, the mesh anode has a rectangular anode frame A111. An opening A111*a* is formed in the anode frame A111. A mesh electrode A112 is provided in the opening A111*a* and fixed to cover the same. A dynode Dy111 of the final stage from among dynodes of a plurality of stages is positioned opposing the mesh electrode A112. A flat rectangular surface A116 is provided on a long side A111C of the rectangular anode frame A111 and forms a prescribed angle with the flat surface including the mesh electrode A112 and anode frame A111. A single long side of the flat rectangular surface A116 is integrally formed with the long side A111C. Triangular shaped anode side surfaces A117 forming a plane that includes each short side of the anode frame A111 and flat rectangular surface A116 is provided on the two short sides of the anode frame A111 and the two short sides of the flat rectangular surface A116. This construction prevents the mesh anode from flexing or bending.

However, the conventional photomultiplier tube disclosed in Japanese unexamined patent application publication No. SHO-60-254547 is not equipped with the high vibration resistance that is essentially required for oil exploration and the like. The mesh anode employed in this photomultiplier tube has insufficient resistance to vibration and cannot be used for oil exploration and the like.

Further, while the photomultiplier tube disclosed in Japanese examined patent application publication No. SHO-61-17099 is configured to prevent flexing and bending of the anode, the anode has insufficient resistance to vibration. Also, since this photomultiplier tube has a complex construction, it is not possible to manufacture the photomultiplier tube easily.

In view of the foregoing, it is an object of the present invention to provide a photomultiplier tube having an anode with excellent vibration resistance and good pulse linearity characteristics.

DISCLOSURE OF THE INVENTION

The photomultiplier tube according to the present invention includes a tube-shaped vacuum vessel extending along the tube axis; a photocathode positioned on one end of the tube-shaped vacuum vessel in the tube axis, for converting incident light to electrons; a plurality of dynodes arranged in n stages each having a secondary electron emitting surface formed on their inner walls, for multiplying electrons sequentially; and an anode for receiving the electrons multiplied by the plurality of dynodes, the anode including a mesh electrode and an anode frame for retaining the mesh electrode. The anode frame is substantially rectangular in shape. An electron converging part at which electrons multiplied by the plurality of dynodes converge is formed near the center part on one long side of the anode frame. The inner surface of the anode frame has a shape that is nearest to the one long side of the anode frame at a center point of the long side and is gradually farther from the one long side with increased distance from the center point. Accordingly, the anode frame grows thicker on the long side with increased distance from the center point.

With this construction, the anode frame grows thicker along one long side farther away from the center point since the inner part of the anode frame is drawn into the frame in relation to the outer surface of the frame while moving away from the center point of the long side. Accordingly, it is possible to produce a photomultiplier tube having an anode with both high pulse linearity characteristics and high vibration resistance. With this simple construction, it is possible to develop this photomultiplier tube having an anode with both good pulse linearity characteristics and good vibration resistance simply by adding on to the conventional line focus type photomultiplier tube.

In the photomultiplier tube of the present invention, the anode is positioned such that the electron converging part falls within a space between an $(n-1)^{th}$ stage dynode and an $(n-2)^{th}$ stage dynode.

With this construction, since the electron converging part is positioned between the dynodes of the $(n-1)^{th}$ stage and the $(n-2)^{th}$ stage, it is possible to achieve better pulse linearity characteristics.

The photomultiplier tube of the present invention is provided with two base plates for supporting the plurality of dynodes and the anode in the tube-shaped vacuum vessel in order to prevent the plurality of dynodes and the anode from moving relative to the vacuum vessel. First support units are provided on both lengthwise ends of one long side of the anode frame and protrude outward from the anode frame parallel to the long side, while second support units are provided on both lengthwise ends of the other long side of the anode frame and protrude outward from the anode frame parallel to the other long side. The anode is supported in the base plates by inserting and fixing the first and second support units in slit-like through-holes formed in the base plates.

Since the anode is supported in the base plates by inserting and fixing two ear parts near the electron converging part and two ear parts away from the electron converging part into slit-like through-holes formed in the base plates, the anode can be removably fixed in relation to each dynode.

In the photomultiplier tube of the present invention, the portion of the inner surface of the anode frame defining one long side of the anode frame includes a first curved surface positioned within the electron converging part and second curved surfaces.

According to this photomultiplier tube, by providing first and second curved surfaces, it is possible to form only the center part of the long side narrow, while the side grows thicker in portions outside of the electron converging part of the anode frame. Accordingly, it is possible to increase the vibration resistance of this long side.

In the photomultiplier tube of the present invention, the mesh electrode has a planar shape, and the other long side forming part of the anode frame is thicker at any point than any point along the first long side. An anode wall is provided on the outer surface of the other long side and extends along the lengthwise direction of the other long side, protruding perpendicular to the mesh electrode.

With this construction, the anode wall provided lengthwise along the other long side, which is thicker than the first long side, can increase the vibration resistance of the other long side.

In the photomultiplier tube of the present invention, it is possible to provide a shielding plate between the dynode of the first stage and the dynodes of the $(n-3)^{th}$ through $n^{th}$ stages.

This construction can prevent light and ions generated when electrons collide with dynodes of the $(n-3)^{th}$ through $n^{th}$ stages from traveling toward the photocathode.

BEST MODE FOR CARRYING OUT THE INVENTION

Figure 1:
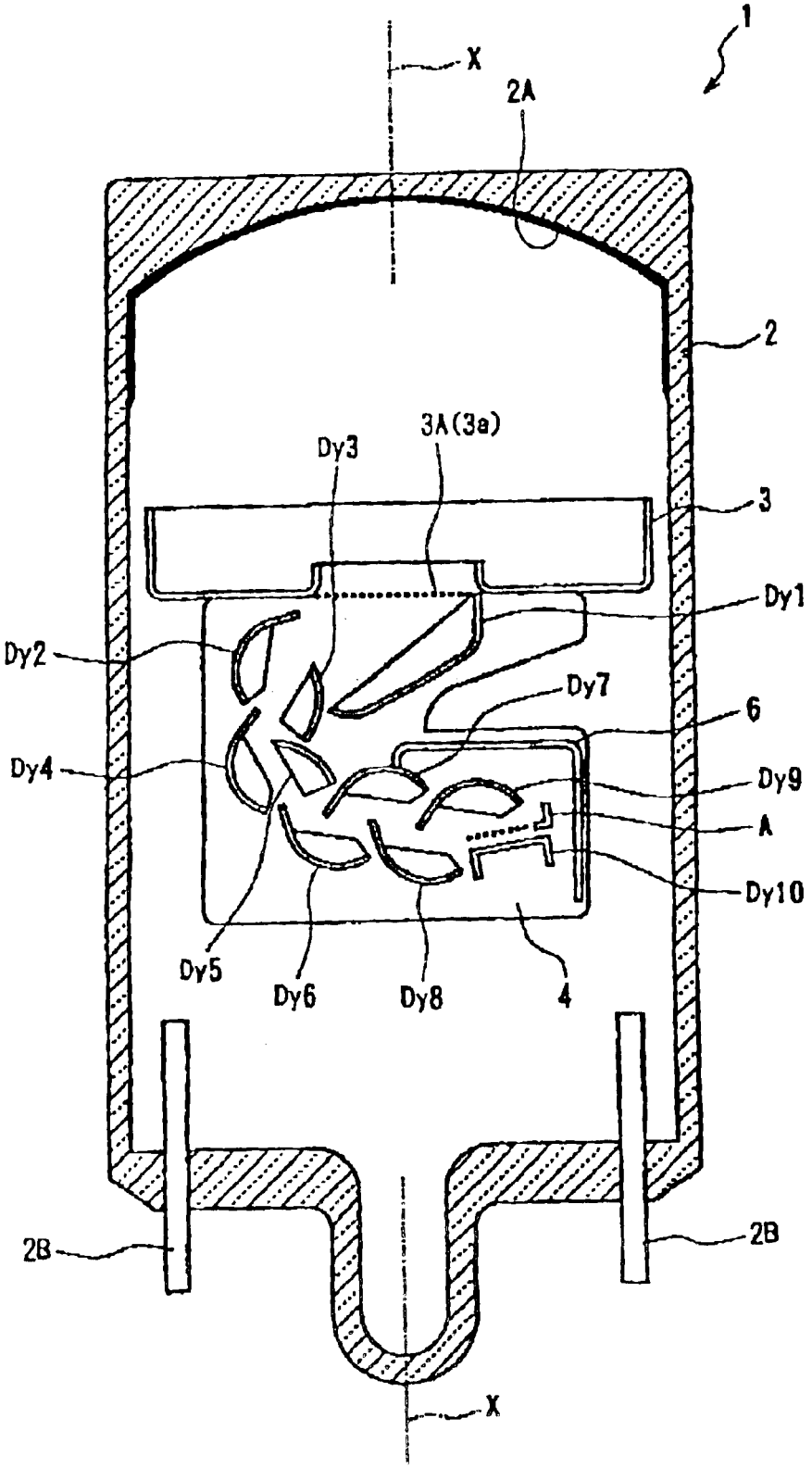
FIG. 1 is a cross-sectional view showing the photomultiplier tube 1 according to an embodiment of the present invention.
Figure 2A:
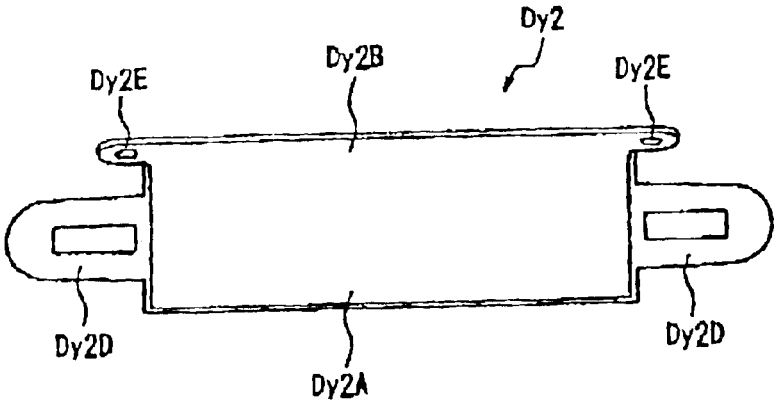
FIG. 2(*a*) is a front view, FIG. 2(*b*) bottom view, FIG. 2(*c*) side view, and FIG. 2(*d*) perspective view showing the shape of the dynodes Dy2, Dy4, and Dy6–Dy9 of the second, fourth, and sixth through ninth stages in the photomultiplier tube 1 according to the embodiment of the present invention.
Figure 2C:
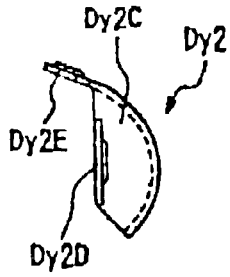
Figure 2B:
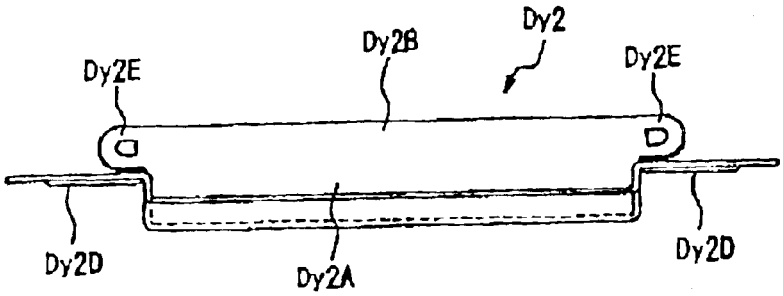
Figure 2D:
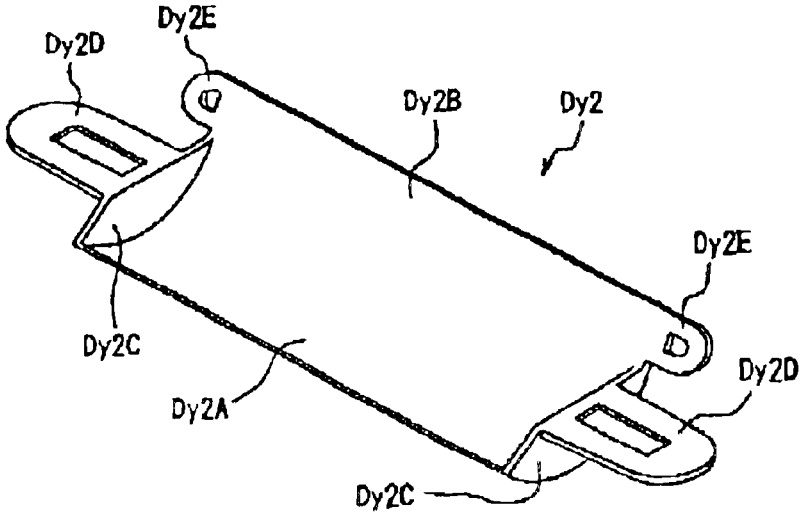
Figure 3A:
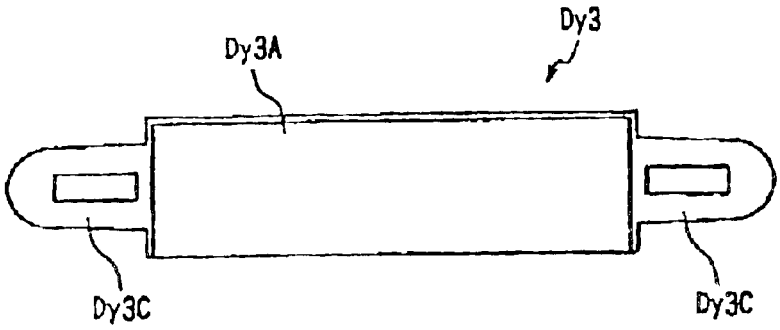
FIG. 3(*a*) is a front view, FIG. 3(*b*) bottom view, FIG. 3(*c*) side view, and FIG. 3(*d*) perspective view of showing the shape of the dynodes Dy3 and Dy5 of the third and fifth stages in the photomultiplier tube 1 according to the embodiment of the present invention.
Figure 3C:
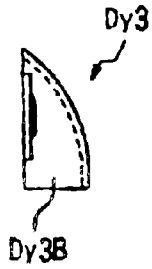
Figure 3B:
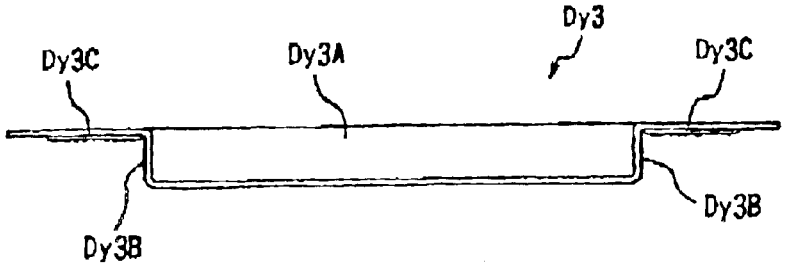
Figure 3D:
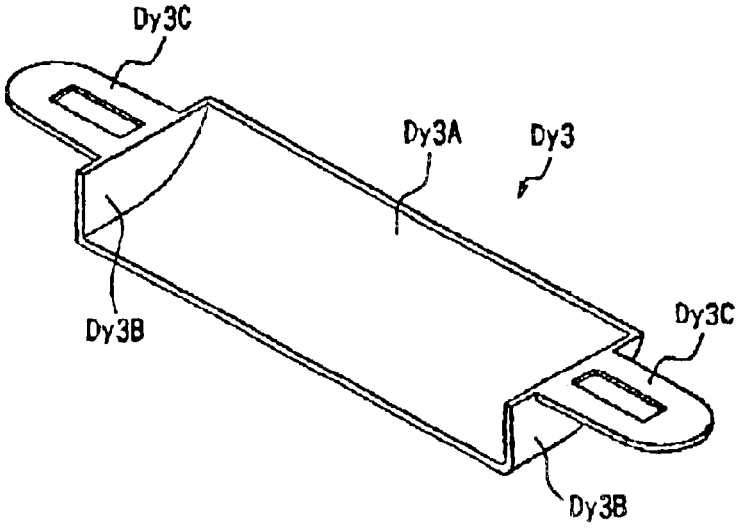
Figure 4A:
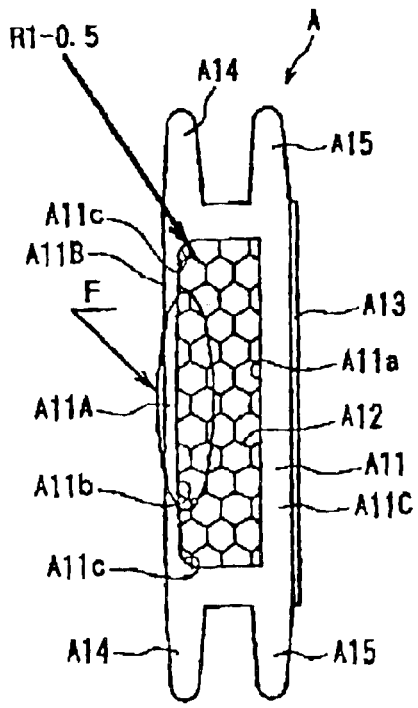
FIG. 4(*a*) through FIG. 4(*d*) are front views showing various anodes A in the photomultiplier tube 1 according to various embodiments of the invention, wherein FIG. 4(*a*) shows a first embodiment, FIG. 4(*b*) second embodiment, FIG. 4(*c*) third embodiment, and FIG. 4(*d*) shows fourth embodiment of the present invention.
Figure 4B:
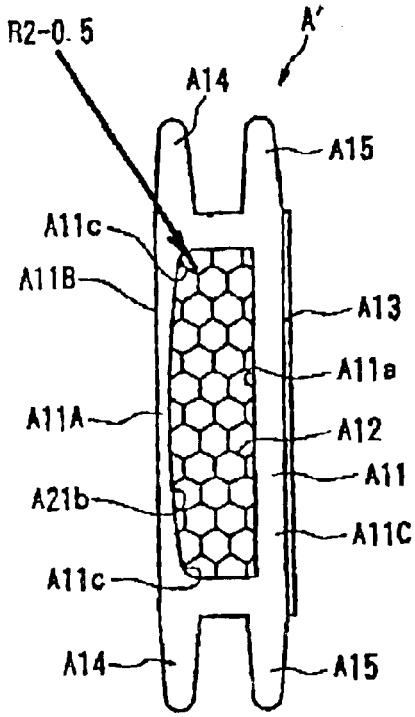
Figure 4C:
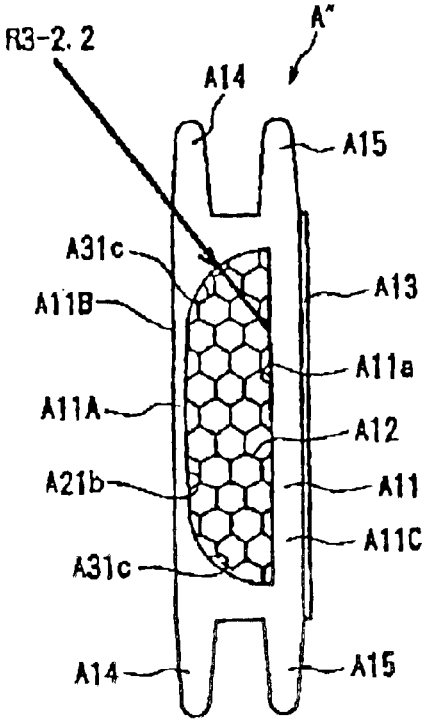
Figure 4D:
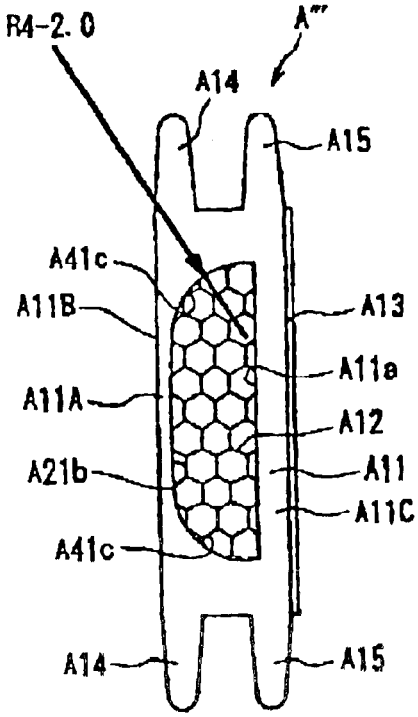

A photomultiplier tube according to a first embodiment of the present invention will be described while referring to FIGS. 1–6. A photomultiplier tube 1 according to the first embodiment includes a tube-shaped vacuum vessel 2 having a tube axis X. FIG. 1 is a cross-sectional view of the photomultiplier tube 1 cut along the tube axis X. The tube-shaped vacuum vessel 2 is formed of Kovar glass or a like material.

Both ends of the tube-shaped vacuum vessel 2 along the tube axis X are closed. One end has a planar shape. A photocathode 2A is formed on the inner surface of this planar end for emitting electrons in response to incident light. The photocathode 2A is formed by reacting an alkali metal vapor with antimony that has been pre-deposited on the inner surface of the end. A plurality of lead pins 2B are provided on the other end of the tube-shaped vacuum vessel 2 for applying prescribed potentials to dynodes Dy1–Dy10 and an anode A. FIG. 1 shows only two of the lead pins 2B for convenience of illustration. Connecting parts not shown in the drawings serve to connect the photocathode 2A to a corresponding lead pin 2B via which a potential of −1000V is applied.

A cup-shaped focusing electrode 3 having a surface perpendicular to the tube axis X is disposed in a position facing the photocathode 2A. A center opening 3*a* centered at the point of intersection of the tube axis X and on a plane perpendicular thereto is formed in the focusing electrode 3. A mesh electrode 3A is mounted in the center opening 3*a*. The focusing electrode 3 and mesh electrode 3A are connected to corresponding lead pins 2B and have the same potential as the dynode Dy1 of the first stage.

The dynodes Dy1–Dy10 are disposed on the opposite side of the focusing electrode 3 from the photocathode 2A for sequentially multiplying electrons. The dynodes Dy1–Dy10 each have secondary electron emitting surfaces.

The dynode Dy1 of the first stage is disposed at a position facing the center opening 3*a* and intersecting the tube axis X. The dynodes Dy1–Dy10 are disposed such that the secondary electron emitting surfaces of neighboring dynodes oppose each other. The dynodes Dy1–Dy10 are positioned such that the paths formed between spaces of opposing dynodes continue from one to the next and intersect the tube axis X. The anode A is disposed on the opposite side of the tube axis X from the dynode Dy2 of the second stage. That is, as shown in FIG. 1, the dynode Dy2 of the second stage is positioned on the left side of the tube axis X, while the anode A is positioned on the right. The mesh-shaped anode A is positioned between the dynode Dy10 of the tenth stage, serving as the final stage, and the dynode Dy9 of the ninth stage, one stage above the final stage.

Each of the dynodes Dy1–Dy10 and the anode A are connected to corresponding lead pins 2B by wires not shown in the drawings via which prescribed voltages are applied. In the first embodiment, the voltages applied to the dynodes Dy1–Dy10 are as follows: dynode Dy1=−800 V, dynode Dy2=−720 V, dynode Dy3=−640 V, dynode Dy4=−560 V, dynode Dy5=−480 V, dynode Dy6=−400 V, dynode Dy7=−320 V, dynode Dy8=−240 V, dynode Dy9=−160 V, dynode Dy10=−80 V, and anode A=0 V.

The dynodes Dy2, Dy4, and Dy6–Dy9 are formed in identical shapes. FIGS. 2(*a*) through 2(*d*) show the shape of the dynode Dy2 in more detail. The dynode Dy2 has a curved surface Dy2A having an arcuate cross-section and a flat surface Dy2B formed continuously and flush with the curved surface Dy2A. The curved surface Dy2A and flat surface Dy2B make up the secondary electron emitting surface. Side walls Dy2C erected from the curved surface Dy2A are formed through a pressing process on either lengthwise end of the curved surface Dy2A. First ears Dy2D extend outward from either side surface of the side walls Dy2C. Second ears Dy2E extend outward from both lengthwise ends of the flat surface Dy2B. The first and second ears Dy2D and Dy2E are not parallel to each other but form a fixed angle. Lugs are formed in the centers of the first ears Dy2D and second ears Dy2E by a pressing process.

The dynodes Dy3 and Dy5 of the third and fifth stages also have the same shape. FIG. 3(*a*) through FIG. 3(*d*) show the shape of the dynode Dy3 of the third stage in more detail. The dynode Dy3 of the third stage has a curved surface Dy3A with an arcuate cross-section. The curved surface Dy3A forms the secondary electron emitting surface and has a smaller surface area than the secondary electron emitting surfaces of dynodes in other stages (Dy2A+Dy2B). With this construction, the dynode Dy3 (and dynode Dy5) is formed smaller than dynodes of other stages. Further, side walls Dy3B protrude from each end of the curved surface Dy3A and are formed by a pressing process. First ears Dy3C are formed in a planar shape and extend outward from the side walls Dy3B perpendicular to the same on the opposite side from the curved surface Dy3A. Lugs are formed in the center portions of the first ears Dy3C by a pressing process.

Figure 6:
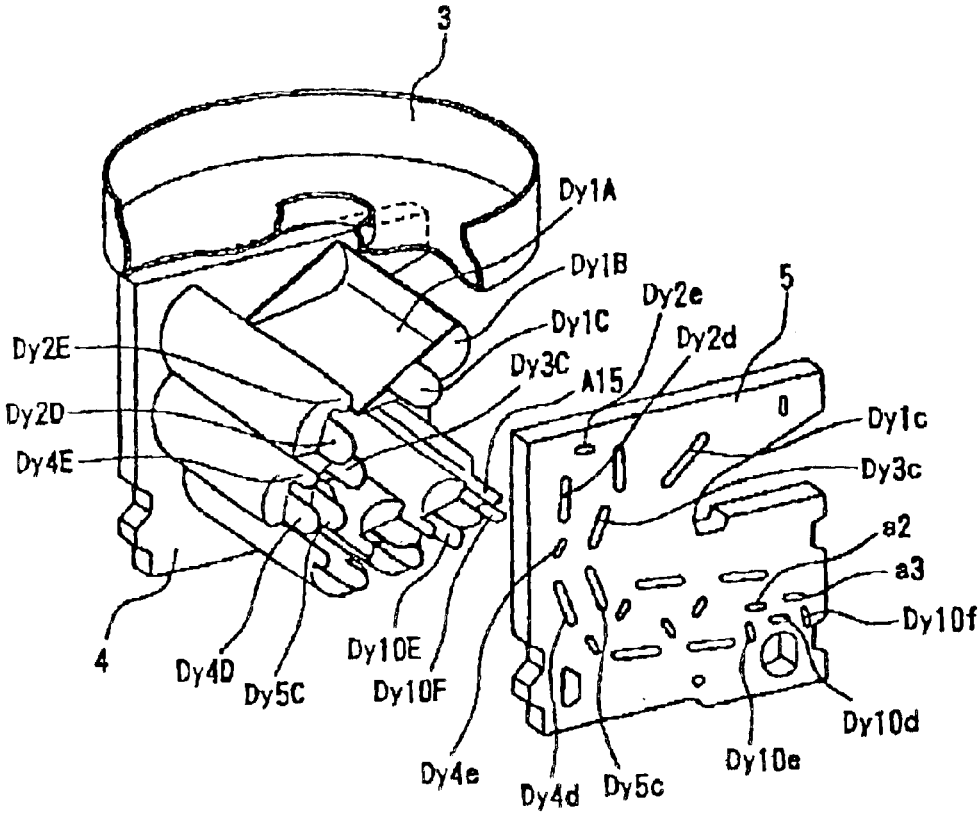
FIG. 6 is a perspective view showing how the dynodes Dy1–Dy10 and the anode A are inserted into the base plate 5.

As can be seen in FIG. 6, side surfaces Dy1B stand upward from secondary electron emitting surfaces Dy1A on both lengthwise ends thereof, while first ears Dy1C extend outward from the side surfaces Dy1B. Lugs are formed in the center portions of the first ears Dy1C by a pressing process.

Figure 5:
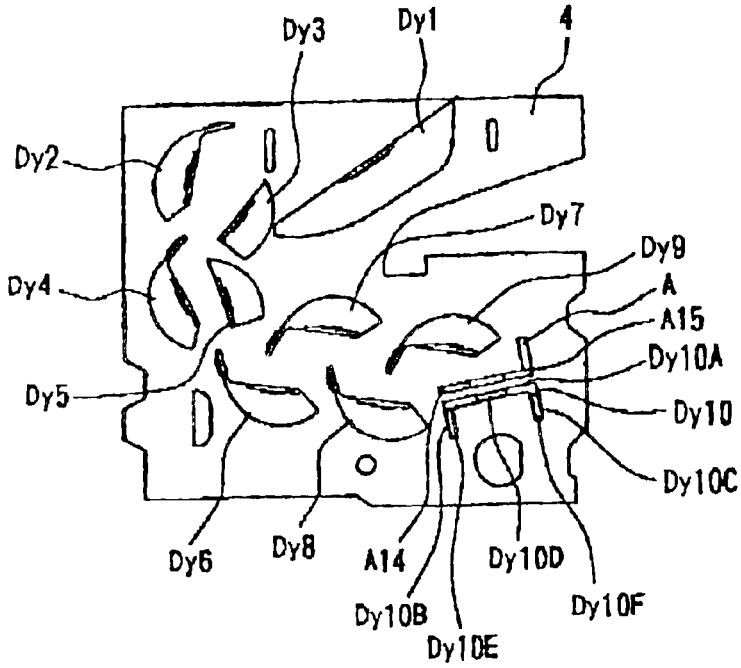
FIG. 5 is a front view showing the dynodes Dy1–Dy10 and the anode A retained in the base plate 4.

As shown in FIG. 5, the dynode Dy10 of the tenth stage has a planar secondary electron emitting surface Dy10A and two surfaces Dy10B and Dy10C standing out from both ends of the secondary electron emitting surface Dy10A. Hence, the dynode Dy10 of the tenth stage is formed in the shape of a three-sided rectangle. Three ears Dy10D, Dy10E, and Dy10F extend along the same plane as the secondary electron emitting surfaces Dy10A, Dy10B, and Dy10C, respectively and are formed on both lengthwise ends of the same. The ears Dy10E and Dy10F are parallel to one another, but perpendicular to the ears Dy10D. Lugs are formed in the center portions of the ears Dy10D, Dy10E, and Dy10F by a pressing process.

Next, the construction of the anode A will be described. As shown in FIG. 4(*a*), the anode A has an anode frame A11 substantially rectangular in shape. The length of a long side in the anode frame A11 is 11 mm. The length of a short side is 3.48 mm. An opening A11*a* is formed in the anode frame A11. A mesh electrode A12 having a honeycomb construction is provided on the inner periphery of the anode frame A11, that is, in the opening A11*a* and is fixed to block the opening A11*a*.

The area near a center part A11A of one long side A11B of the substantially rectangular anode frame A11, that is, the portion indicated by F in FIG. 4(*a*) including the center part A11A itself and a portion of the mesh electrode A12 fixed by the center part A11A, forms an electron converging part at which point most electrons multiplied by the plurality of dynodes Dy1–Dy10 converge. The electron converging part F is positioned in the space between the dynode Dy8 of the eighth stage and the dynode Dy9 of the ninth stage. In order to receive as many electrons as possible by the mesh electrode A12 within the electron converging part F, the long side A11B is configured considerably narrower than the thickness of the other long side A11C of the anode frame A11. The thickness of the center part A11A in the long side A11B is 0.3 mm, while the thickness of the entire other long side A11C is 0.8 mm.

The inner side of the long side A11B draws into the anode A moving away from the center point of the long side A11B toward both ends thereof. A first curved surface A11*b* is an arc of a circle having a radius of 70 mm that connects one end of the other long side A11C to the other end of the same. On the other hand, the two short sides of the anode frame A11 on the inner surface thereof are linear. The portions on the inner surface of the anode frame A11 connecting the linear portion on the inner surfaces of the two short sides to the first curved surface A11*b*, that is, the inner surfaces on both ends of the long side A11B, form second curved surfaces A11*c* that are arcs of a circle having a radius R1, indicated by the arrow in the drawing. The second curved surfaces A11*c* connect the two short sides of the anode frame A11 and the first curved surface A11*b*. The radius R1 is 0.5 mm. The thickness of the junction part connecting the linear part on the inner surfaces of the two short sides of the anode frame A11, the two curved surfaces, and the inner surfaces of the long sides, that is, the thickness of the short sides on both ends of the other long side A11C is 1.0 mm.

Two ear parts A14 near the electron converging part are provided one on either end of the long side A11B parallel to the long side A11B and protruding away from the anode frame A11. Further, two ear parts A15 separated from the electron converging part are provided one on either end of the other long side A11C and parallel to the same and protruding away from the anode frame A11. The ear parts A14 correspond to the first support units, while the ear parts A15 correspond to the second support units. Slit-like through-holes a2 and a3 formed in the base plate 5 and described later are configured to enable the base plate 5 to support the anode A by inserting and fixing the two ear parts A14 and the two ear parts A15 in the through-holes a2 and a3.

An anode wall A13 substantially rectangular in shape is provided lengthwise along the outer surface of the other long side A11C and protrudes vertically in relation to the mesh electrode A12, that is, upward from the surface of the paper in FIG. 4(*a*).

In a line focus photomultiplier tube, electrons emitted from the dynode Dy9 of the ninth stage converge mainly in the electron converging part F of the anode A. From the perspective of improving electrical characteristics, therefore, it would be preferable not to form the long side A11B, and particularly not the center part A11A. However, without these parts it would be impossible to sufficiently maintain the anode A in a vibration environment. The anode A would be prone to damage, and vibration characteristics would be insufficient. The photomultiplier tube would have insufficient vibration resistance even by making the long side A11B as thin as possible, rather than eliminating the same. With the photomultiplier tube of the present invention, however, the inner surface of the long side A11B includes the first curved surface A11*b* and second curved surfaces A11*c*, thereby narrowing only the center part A11A. By making portions of the anode frame A11 thicker outside the electron converging part F, it is possible to improve the vibration resistance of the long side A11B, including the center part A11A.

Further, by making the other long side A11C, which is not included in the electron converging part F, thicker than the long side A11B and providing the anode wall A13 on the outer surface of the other long side A11C, it is possible to increase the vibration characteristics of the other long side A11C.

By also providing the ear parts A14 on parts near the electron converging part F and the ear parts A15 on parts separated from the electron converging part F for supporting the anode A, it is possible to further increase vibration resistance of the mesh anode A.

As shown in FIG. 6, the dynodes Dy1–Dy10 and the anode A are supported on both lengthwise ends in base plates 4 and 5. Slit-shaped fixing holes Dy1*c*, Dy2*d*, Dy2*e*, Dy3*c*, Dy4*d*, Dy4*e*, Dy5*c*, Dy10*d*, Dy10*e*, Dy10*f*, a2, and a3 are formed in the base plate 5. Although not shown in the drawings, identical slit-shaped fixing holes are formed in the base plate 4.

FIG. 5 is a front view showing the dynodes Dy1–Dy10 and the anode A supported in the base plate 4 but not yet supported in the base plate 5. FIG. 6 shows the dynodes Dy1–Dy10 and the anode A about to be inserted into the base plate 5. The following description is identical for the case of supporting the ears Dy1C, Dy2D, Dy2E, Dy3C, Dy4D, Dy4E, Dy5C, Dy10D, Dy10E, and Dy10F of the dynodes Dy1–Dy10 and the anode A in the base plate 4.

The dynode Dy1 of the first stage is supported in the base plate 5 by inserting the first ears Dy1C into the fixing holes Dy1*c*. The dynode Dy2 of the second stage is supported in the base plate 5 by inserting the first ears Dy2D into the fixing holes Dy2*d* and the second ears Dy2E into the fixing holes Dy2*e*. The dynode Dy3 of the third stage is supported in the base plate 5 by inserting the first ears Dy3C into the fixing holes Dy3*c*. The dynode Dy4 of the fourth stage is supported in the base plate 5 by inserting the ears Dy4D into the fixing holes Dy4*d* and the ears Dy4E into the fixing holes Dy4*e*. The dynode Dy5 of the fifth stage is supported in the base plate 5 by inserting the ears Dy5C into the fixing holes Dy5*c*. As with the dynodes Dy2 and Dy4 of the second and fourth stages, the dynodes Dy6–Dy9 are supported in the base plate 5 by inserting the first ears and second ears into the corresponding fixing holes. The dynode Dy10 of the tenth stage is supported in the base plate 5 by inserting the ears Dy10D into the fixing holes Dy10*d*, the ears Dy10E into the fixing holes Dy10*e*, and the ears Dy10F into the fixing holes Dy10*f*. The anode A is supported in the base plate 5 by inserting the ear parts A14 into the fixing holes a2 and the ear parts A15 into the fixing holes a3.

By forming the lugs in each ear, as described above, the ear portions can be inserted into their corresponding fixing holes at this time. The dynodes Dy1–Dy10 are suitably fixed in the base plate 5. The same is true for the ears of the dynodes Dy6–Dy10 of the sixth through ninth stages.

At this time, the first ears Dy1C, Dy2D, Dy3C, Dy4D, and Dy5C, and the ears Dy10E, Dy10F, A14, and A15 are formed longer than the thickness of the base plate 5, thereby protruding from the other side of the base plate 5. These ears serve as terminals for connecting to the lead pins 2B. The same is true for the first ears in the dynodes Dy6–Dy9 of the sixth through ninth stages. By twisting the parts of the ears Dy1C, Dy2D, Dy3C, Dy4D, Dy5C, Dy10E, Dy10F, A14, and A15 protruding from the base plate 5, the dynodes Dy1 through Dy5 and Dy10 and the anode A can be more securely fixed to the base plate 5. The same effect is true for the dynodes Dy6–Dy9 of the sixth through ninth stages.

The second ears Dy2E and Dy4E and the ear Dy10D are each formed shorter than the thickness of the base plate 5. These ears do not protrude from the outer side of the base plate 5 and therefore do not interfere with the wiring. The same description is true for the second ears on the dynodes Dy6–Dy9 of the sixth through ninth stages. Since the number of ears protruding from the base plate 5 can be decreased in this way, it is possible to avoid putting wiring of neighboring ears on dynodes Dy1–Dy10 in close proximity of one another, thereby preventing the problem of voltage proof destruction.

Normally, secondary electrons emitted from the secondary electron emitting surface of a dynode Dyi of the $i^{th}$ stage impinge on a portion of high efficiency of the secondary electron emitting surface in the dynode Dy(i+1) of the $(i+1)^{th}$ stage. Accordingly, the dynode Dy(i+2) of the $(i+2)^{th}$ stage is configured to penetrate between the secondary electron emitting surface of the dynodes Dyi and Dy(i+1) of the $i^{th}$ and $(i+1)^{th}$ stages, respectively. In the photomultiplier tube 1 of the present embodiment, the dynodes Dy1–Dy10 are arranged in a curving series in order that the path formed in the spaces between dynodes cuts across the tube axis. Accordingly, a greater distance is formed between dynodes arranged on the outer part of the curve. Consequentially, the dynode Dy(i+2) of the $(i+2)^{th}$ stage positioned on the outer side of the curve generally does not penetrate between the secondary electron emitting surfaces of the dynodes Dyi and Dy(i+1) of the $i^{th}$ and $(i+1)^{th}$ stages. However, the secondary electron emitting surfaces of the dynodes Dy2, Dy4, Dy6, and Dy8 of the second, fourth, sixth, and eighth stages disposed on the outer part of the curve in the present embodiment are formed continuously with the curved surfaces Dy2A, Dy4A, Dy6A, and Dy8A having an arcuate cross-section. Therefore, as shown in FIG. 1, the dynode Dy(i+2) of the $(i+2)^{th}$ stage penetrates between the secondary electron emitting surfaces of the dynodes Dyi and Dy(i+1) of the $i^{th}$ and $(i+1)^{th}$ stages. As a result, the potential of the dynode Dy(i+2) of the $(i+2)^{th}$ stage leaks between the dynodes Dyi and Dy(i+1) of the $i^{th}$ and $(i+1)^{th}$ stages. Hence, secondary electrons emitted from the secondary electron emitting surface of the dynode Dyi of the $i^{th}$ stage are attracted to the dynode Dy(i+2) of the $(i+2)^{th}$ stage, enabling secondary electrons to be impinged on the part of high efficiency in the secondary electron emitting surface of the Dy(i+1) of the $(i+1)^{th}$ stage.

Here, the secondary electron emitting surfaces of the dynodes Dy3 and Dy5 of the third and fifth stages are formed only by the parts having an arcuate cross-section in order to facilitate reception of electrons from the dynodes Dy2 and Dy4 of the previous stages. Moreover, the secondary electron emitting surfaces are adjusted to emit electrons in a direction slightly toward the dynodes Dy2 and Dy4 of the previous stages so that the secondary electrons trace a correct trajectory in relation to the dynodes Dy4 and Dy6 of the next stages. If the secondary electron emitting surfaces of the dynodes Dy3 and Dy5 of the third and fifth stages were flat, too much potential of the dynodes Dy3 and Dy5 would leak between the dynodes Dy2 and Dy4 of the previous stage and the dynodes Dy1 and Dy3 of the previous, previous stages, causing electrons from the dynodes Dy1 and Dy3 to be attracted to the back surfaces of the dynodes Dy3 and Dy5. This would make it difficult to impinge secondary electrons on the secondary electron emitting surfaces of the dynodes Dy2 and Dy4. Electrons emitted from the secondary electron emitting surfaces of the dynodes Dy2 and Dy4 would be attracted to the potential of the dynodes Dy5 and Dy7. Accordingly, the electrons would either not impinge at a desirable position on the dynodes Dy3 and Dy5 or would slip past the next stages of dynodes and impinge on the back surfaces of the dynodes Dy5 and Dy7.

Further, the secondary electron emitting surfaces of the dynodes Dy3 and Dy5 of the third and fifth stages have a smaller surface area than the secondary electron emitting surfaces of the dynodes Dy2, Dy4, and Dy6 through Dy9 of the second, fourth, and sixth through ninth stages in order to reduce the size of the dynodes Dy3 and Dy5 of the third and fifth stages arranged in the center of the curved series of dynodes. Hence, the dynodes Dy1–Dy10 can be arranged in a curved series such that the path in the spaces between dynodes crosses the tube axis. On the other hand, the secondary electron emitting surfaces of the dynodes Dy7 and Dy9 of the seventh and ninth stages arranged on the inner side of the curved series have the same surface area as the secondary electron emitting surfaces of the dynodes Dy2, Dy4, Dy6, and Dy8 of the second, fourth, sixth, and eighth stages arranged on the outer side of the curved series in order to slightly relax the increasing density of electrons near the secondary electron emitting surfaces of the dynodes Dy7 and Dy9 positioned relatively close to the final stage.

As shown in FIG. 1, a flat shielding plate 6 is provided parallel to the photocathode 2A and positioned around the dynodes Dy1–Dy10. The shielding plate 6 is positioned between the dynodes Dy7–Dy10 near the final stage and the dynode Dy1 of the first stage to prevent light or ions generated when electrons collide with the dynodes Dy7–Dy10 near the final stage from migrating toward the photocathode 2A. A prescribed voltage is applied to the shielding plate 6 by connecting the shielding plate 6 to a corresponding lead pin 2B.

Next, the operations of the photomultiplier tube 1 according to the first embodiment will be described with reference to FIG. 1. When light is incident on the photocathode 2A, photoelectrons are emitted. The photoelectrons are converged by the focusing electrode 3 and transferred to the dynode Dy1 of the first stage. At this time, secondary electrons are emitted from the dynode Dy1 and sequentially transmitted to the dynodes Dy2 through Dy10 of the second through tenth stages, causing an amplification cascade of sequentially generated secondary electrons. Ultimately, the secondary electrons are collected in the anode A and extracted therefrom as an output signal.

Next, a photomultiplier tube according to a second embodiment will be described. The photomultiplier tube according to the second embodiment differs from the photomultiplier tube according to the first embodiment in the curvature of a first curved surface A21*b* of an anode A'. The curvature of the first curved surface A21*b* according to the second embodiment is 30 mm, as shown in FIG. 4(*b*). A description of other parts of the anode A' will be omitted, as they are identical to those described in the first embodiment.

Next, a photomultiplier tube according to a third embodiment of the present invention will be described. The photomultiplier tube according to the third embodiment of the present invention differs from the photomultiplier tube according to the second embodiment of the present invention by a differing curvature in a second curved surfaces A31*c* of an anode A". Since the curvature of the second curved surfaces A31*c* differs in the photomultiplier tube of the present embodiment, the shape of the anode frame and the shape of the mesh electrode also differ slightly.

In the photomultiplier tube according to the third embodiment, the inner surfaces of the two short sides of the anode frame A11 in the anode A" do not have a linear shaped portion. However, the inner surface of the other long side of the anode frame A11 is linear. The inner surfaces of the short sides form the second curved surfaces A31*c*. The curvature R3 of the second curved surfaces A31*c* is much larger than that of the second curved surfaces A11*c* in the photomultiplier tube according to the second embodiment. The curvature R3 of the second curved surfaces A31*c* is 2.2 mm. The two second curved surfaces A31*c* connect either end of the first curved surface A21*b* to either end of the inner surface of the other long side A11C. The thickness of the junction connecting the second curved surfaces A31*c* to the inner surface of the other long side A11C on the short sides of the anode frame A11, that is, the thickness of the short sides on both ends of the other long side A11C is 1.0 mm.

By providing the second curved surfaces A31*c* with a large curvature, it is possible to narrow the center portion of the anode frame A11, while increasing the portions on both ends of the other long side A11C in the anode frame A11. As a result, the present invention can increase pulse linearity, as well as vibration resistance.

Next, a photomultiplier tube according to a fourth embodiment of the present invention will be described. The photomultiplier tube according to the fourth embodiment differs from the photomultiplier tube according to the third embodiment by having a different curvature in a second curved surfaces A41*c* of an anode A'" and a different thickness in the short sides of the anode frame A11. A curvature R4 of the second curved surfaces A41*c* according to the fourth embodiment is 2.0 mm. Further, the thickness of the junction connecting the second curved surfaces A41*c* and the inner surface of the other long side A11C and on the short sides of the anode frame A11, that is, the thickness of the short sides on both ends of the other long side A11C is 1.5 mm, 0.5 mm larger than the other embodiment. A description of other parts of the photomultiplier tube has been omitted, as these parts are identical to those described in the third embodiment.

While decreasing the curvature of the second curved surfaces A41*c*, the junction connecting the second curved surfaces A41*c* and the inner surface of the other long side A11C is made thicker, enabling the center portion of the anode frame A11 to be narrow and the portions on both ends of the other long side A11C to be made thicker. As a result, it is possible to maintain high pulse linearity to some degree, while further increasing vibration resistance.

An experiment was then conducted to confirm the effects of the photomultiplier tube according to the present invention. To begin with, the output current was measured in the photomultiplier tube according to embodiments 1–4. The quality of pulse linearity for the mesh anode was determined by finding what is known as the rate of change. The same experiment was conducted using a conventional photomultiplier tube having a pole type anode as an object for comparison. The results of the experiments are shown in Table 1. The graph shown in FIG. 7 was created to make the data shown in Table 1 visually easy to understand. Table 1 lists the values of rate of change for the embodiments 1–4 and the conventional pole-shaped anode when the output current is 1, 3, 5, 10, . . . , and 100 mA. The output current (mA) is graphed in units on the vertical axis, while the rate of change (%) is graphed in units on the horizontal axis.

TABLE 1

| | 1st embodiment | | 2nd embodiment | | 3rd embodiment | | 4th embodiment | | Prior Art pole-shaped anode |
|---|---|---|---|---|---|---|---|---|---|
| 1 | 0 | 0 | 0 | 0 | 0 | 0 | 0 | 0 | 0 |
| 3 | −0.082 | −0.012 | −0.14 | −0.086 | 0.011 | 0.383 | 0.259 | −0.146 | −1.23 |
| 5 | −0.072 | 0.016 | −0.282 | −0.037 | 0.118 | 0.272 | 0.143 | −0.395 | −2.25 |
| 10 | −0.512 | −0.407 | −0.606 | −0.041 | −0.311 | 0.017 | −0.328 | −1.11 | −5.58 |
| 30 | −2.24 | −1.68 | −2.33 | −1.86 | −2.62 | −1.9 | −2.95 | −4.04 | −18.4 |
| 40 | −4.04 | −2.92 | −3.61 | −3.27 | −4.43 | −3.49 | −4.8 | −6.01 | −24 |
| 50 | −5.56 | −4.41 | −5.12 | −4.87 | −6.42 | −5.22 | −6.82 | −8.1 | |
| 60 | −7.26 | −6.3 | −6.92 | −6.59 | −8.73 | −7.11 | −9.51 | −10.5 | |
| 80 | −12.1 | −12.1 | −11.8 | −11.7 | −15.3 | −12.8 | −16.9 | −16.6 | |
| 100 | −18.9 | −20.4 | −18.1 | −18.4 | −23.4 | −20.3 | −24.9 | −24.9 | |

Units on horizontal: rate of change (%)
Units on vertical: Output current (mA)

Figure 7:
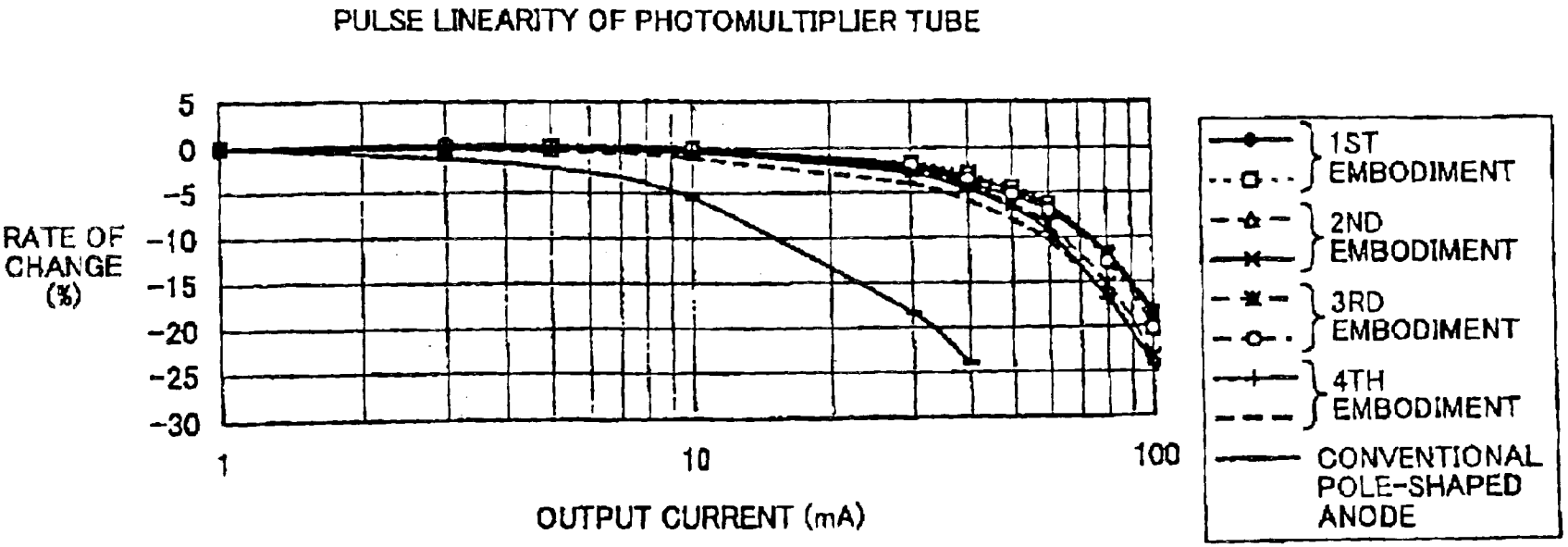
FIG. 7 is a graph showing pulse linearity characteristics of the photomultiplier tube according to the preferred embodiments.
Figure 8:
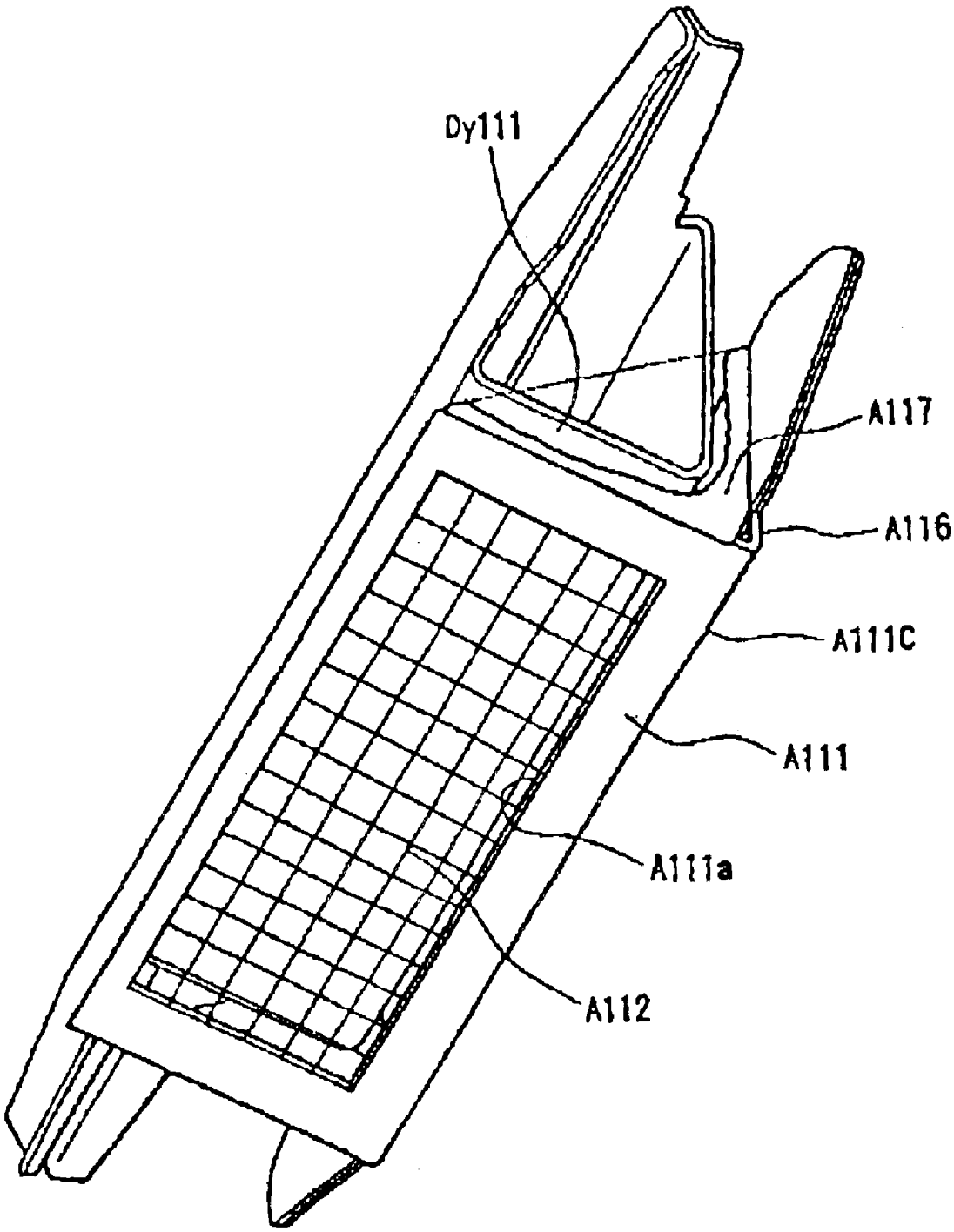
FIG. 8 is a partial cross-sectional view showing the anode of a conventional photomultiplier tube.

As shown in Table 1 and the graph of FIG. 7, all of the photomultiplier tubes according to the first, second, third, and fourth embodiments obtained good pulse linearity characteristics. One can see that the photomultiplier tube according to the present invention improves the pulse linearity characteristics more than five times that of the conventional pole-shaped anode.

Next, an experiment for vibration resistance was conducted using the mesh anode according to the first through fourth embodiments. The experiment for vibration resistance was conducted by mounting the mesh anode in the test device and applying vibrations to the mesh anode at 294 $m/S^2$ (=30 G), 50–2,000 Hz, 1 octave/minute, 1 sweep/axis (3 axes), and 10 minutes/axis. The quality of vibration resistance was determined based on whether output variations from the anode occurred due to damage or deformation of the mesh anode. The same experiment was conducted using the conventional pole-shaped anode for comparison purposes. Here, the three axes refer to the X, Y, and Z axes.

As the conventional pole-shaped anode is well known to have superior vibration resistance, it was no surprise that output variations did not occur within the time allotted for the experiment. However, all of the mesh anodes in the photomultiplier tube of the first through fourth embodiments did not incur damage during the time prescribed for the experiment, exhibiting sufficient vibration resistance for use as a product. Theoretically, the photomultiplier tube of the present invention is thought to achieve vibration resistance in order from highest to lowest by the fourth, third, second, and first embodiments.

When considering the best combination of vibration resistance and pulse linearity, the mesh anode used in the photomultiplier tube of the second embodiment is best. If one wants to emphasize pulse linearity and does not require that much vibration resistance, then the mesh anode in the photomultiplier tube of the first embodiment is best. In contrast, if one wishes to emphasize vibration resistance and does not require high pulse linearity, then the mesh anode in the photomultiplier tube of the fourth embodiment is best. In this way, it is possible to freely select the most appropriate anode based on the use and objective of the photomultiplier tube.

The present invention is not limited to the embodiments described above; rather many modifications and variations may be made to the above descriptions without departing from the spirit of the invention, the scope of which is defined by the attached claims. For example, the embodiments described above are configured of line focus dynodes in a plurality of stages that are arranged in a curve, but the plurality of line focus dynodes can also be arranged in-line, as usual. The electron converging part of the mesh anode can be positioned in the space between the dynodes of the $(n-1)^{th}$ stage and $(n-2)^{th}$ stage, even when dynodes of n stages are arranged in-line, where n is a natural number of 3 or greater. For this reason, it is desirable that the long side of the anode frame be formed identical to the present invention.

Further, it is not necessary to form the inner surface of the long side A11B by first and second curves. It is possible to form the long side A11B partially linear, provided that the center part A11A is the narrowest portion.

INDUSTRIAL APPLICABILITY

As described above, the photomultiplier tube of the present invention is used in a wide range of applications when high vibration resistance is required, such as in oil exploration and the like, or when high pulse linearity characteristics and high precision light detection are required.

What is claimed is:

1. A photomultiplier tube comprising:

a tube-shaped vacuum vessel extending along a tube axis, the tube-shaped vacuum vessel having a first end and a second end in relation to the tube axis;

a photocathode positioned on the first end of the tube-shaped vacuum vessel, for converting incident light to electrons;

a plurality of dynodes arranged in n stages each having a secondary electron emitting surface formed on an inner wall thereof, for multiplying electrons sequentially; and an anode for receiving the electrons multiplied by the plurality of dynodes, the anode including a mesh electrode and an anode frame for retaining the mesh electrode, wherein the anode frame is substantially rectangular in shape wherein an electron converging part at which electrons multiplied by the plurality of dynodes converge is formed near a center part on one long side of the anode frame, and wherein inner surface of the anode frame has a such a shape that is nearest to the one long side of the anode frame at a center point of the one long side and that is gradually farther from the one long side with increased distance from the center point, so that the anode frame grows thicker on the one long side with increased distance from the center point.

2. The photomultiplier tube as recited in claim 1, wherein the anode is positioned such that the electron converging part falls within a space between an $(n-1)^{th}$ stage dynode and an $(n-2)^{th}$ stage dynode.

3. The photomultiplier tube as recited in claim 1, further comprising two base plates provided in the tube-shaped vacuum vessel for supporting the plurality of dynodes and the anode in order to prevent the plurality of dynodes and the anode from moving relative to the vacuum vessel, wherein first support portions are provided on both lengthwise ends of the one long side of the anode frame and protrude outward from the anode frame parallel to the one long side, while second support portions are provided on both lengthwise ends of the other long side of the anode frame and protrude outward from the anode frame parallel to the other long side, and wherein the anode is supported in the base plates by inserting and fixing the first support portions and second support portions in slit-like through-holes formed in the base plates.

4. The photomultiplier tube as recited in claim 1, wherein a portion of the inner surface of the anode frame defining the one long side of the anode frame includes a first curved surface positioned within the electron converging part and second curved surfaces.

5. The photomultiplier tube as recited in claim 1, wherein the mesh electrode has a planar shape, and the other long side forming part of the anode frame is thicker at any point than any point along the one long side, and wherein an anode wall is provided on an outer surface of the other long side and extends along a lengthwise direction of the other long side, protruding perpendicular to the mesh electrode.

6. The photomultiplier tube as recited in claim 1, further comprising a shielding plate disposed between the dynode of a first stage and the dynodes of $(n-3)^{th}$ through $n^{th}$ stages.

7. The photomultiplier tube as recited in claim 2, further comprising two base plates provided in the tube-shaped vacuum vessel for supporting the plurality of dynodes and the anode in order to prevent the plurality of dynodes and the anode from moving relative to the vacuum vessel, wherein first support portions are provided on both lengthwise ends of the one long side of the anode frame and protrude outward from the anode frame parallel to the one long side, while second support portions are provided on both lengthwise ends of the other long side of the anode frame and protrude outward from the anode frame parallel to the other long side, and wherein the anode is supported in the base plates by inserting and fixing the first support portions and second support portions in slit-like through-holes formed in the base plates.

* * * * *